US006450830B1

(12) United States Patent
Koseki

(10) Patent No.: US 6,450,830 B1
(45) Date of Patent: Sep. 17, 2002

(54) ELECTRICAL CONNECTOR HAVING IMPROVED LATCHING MEANS

(75) Inventor: Yoshitsugu Koseki, Nagano (JP)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/892,305

(22) Filed: Jun. 25, 2001

(51) Int. Cl.[7] ..... H01R 13/639
(52) U.S. Cl. ..... 439/352
(58) Field of Search ..... 439/352, 358, 439/357, 350, 351, 353–356

(56) References Cited

U.S. PATENT DOCUMENTS 5,011,425 A * 4/1991 Van Zanten et al. ..... 439/353
5,634,809 A * 6/1997 Hirai ..... 439/352
5,653,606 A * 8/1997 Chrysostomou ..... 439/352
6,113,413 A * 9/2000 Cronin et al. ..... 439/352
6,132,231 A * 10/2000 Suzuki ..... 439/352

* cited by examiner

*Primary Examiner*—Gary F. Paumen
(74) *Attorney, Agent, or Firm*—Wei Te Chung

(57) ABSTRACT

An electrical connector includes an upper cover (1), a lower cover (2), between which a space (3) is defined for receiving a terminal block (4) having a plurality of terminals (41) therein, and a latching means (5) assembled on a top of the upper cover. The latching means includes a latch (6) with one pivot point (64) thereof and a slide knob (7). A tongue (68) projects from an end of the latch and extends into an opening (730) defined in an inclined neck (73) of the slide knob. A pair of barbs (66) are formed on the latch to engage with corresponding part of a cooperating connector. By pushing/pulling a driving portion (72) formed on the slide knob, the tongue engages with or disengages from the opening, whereby the latch pivots about the pivot point and the connector connects or disconnects with the cooperating connector.

1 Claim, 3 Drawing Sheets

ELECTRICAL CONNECTOR HAVING IMPROVED LATCHING MEANS

BACKGROUND OF THE INVENTION

1. Field of the Invention

The present invention relates to an electrical connector, and particularly to an electrical connector with an improved lathing means for securely and conveniently latching the electrical connector and a mating connector together 2. Description of Related Art Some kinds of electrical connectors often provide a latching means to securely lock to a mating electrical connector. U.S. Pat. No. 5,011,425 discloses a relevant plug-in connector having a locking element. The locking element has two pivot points spaced apart along a length of the connector and respectively near a first free end and a second free end of the locking element. The first end provides a latching element thereon for engaging with a corresponding part of a mating connector. When the connectors are to be connected or disconnected, a gripping force directed inward toward the plug-in connector is exerted on the second free end of the locking element. The gripping force causes the second free end to pivot about one pivot point and the first free end to pivot about another pivot point, so that the latching element engages with or disengages from the matingconnector. However, the movements of the different parts of the locking element actuated by different stress are too complicated to ensure a reliable locking/unlocking state. In addition, to accommodate different cables having different diameters in the connector, two types of locking elements, including a long-latch type and a short-latch type, are designed, which not only add inconvenience to users during application but also increase manufacturing cost.

Hence, an electrical connector having an improved latching means is required to overcome the disadvantages of the conventional connector.

SUMMARY OF THE INVENTION

Accordingly, the object of the present invention is to provide an electrical connector having an improved latching means for securely and conveniently locking the connector and a mating connector together Another object of the present invention is to provide an electrical connector having an improved latching means which simplifies the manufacturing of the connector.

A further object of the present invention is to provide an electrical connector having an improved latching means by which the assembling efficiency of the connector is raised.

A still further object of the present invention is to provide an electrical connector having an improved latching means which is easy to distinguish a locking engagement and an unlocking engagement between the connector and the mating connector.

In order to achieve the objects abovementioned, an electrical connector comprises an upper cover with an elongated recess being defined on a top thereof, a lower cover cooperating with the upper cover, a terminal block retaining a plurality of terminals therein for being received in a receiving space defined between the upper and lower covers, and a latching means, for locking the electrical connector and the mating connector together, comprising a latch and a slide knob assembled with the latch. The latch provides one pivot point thereof with two free ends opposite to each other, and a tongue projecting from a free end of the latch. The slide knob comprises a head, a driving portion and a neck connecting the head to the driving portion. The neck defines an opening therein for engaging with the tongue of the latch. A pair of barbs are formed at a free end of the latch opposite to the tongue to snap into slots defined in the mating connector. Just by means of pushing/pulling the driving portion of the slide knob, the electrical connector could engage with or disengage from the mating connector.

Other objects, advantages and novel features of the invention will become more apparent from the following detailed description when taken in conjunction with the accompanying drawings.

DETAILED DESCRIPTION OF THE INVENTION

Figure 1:
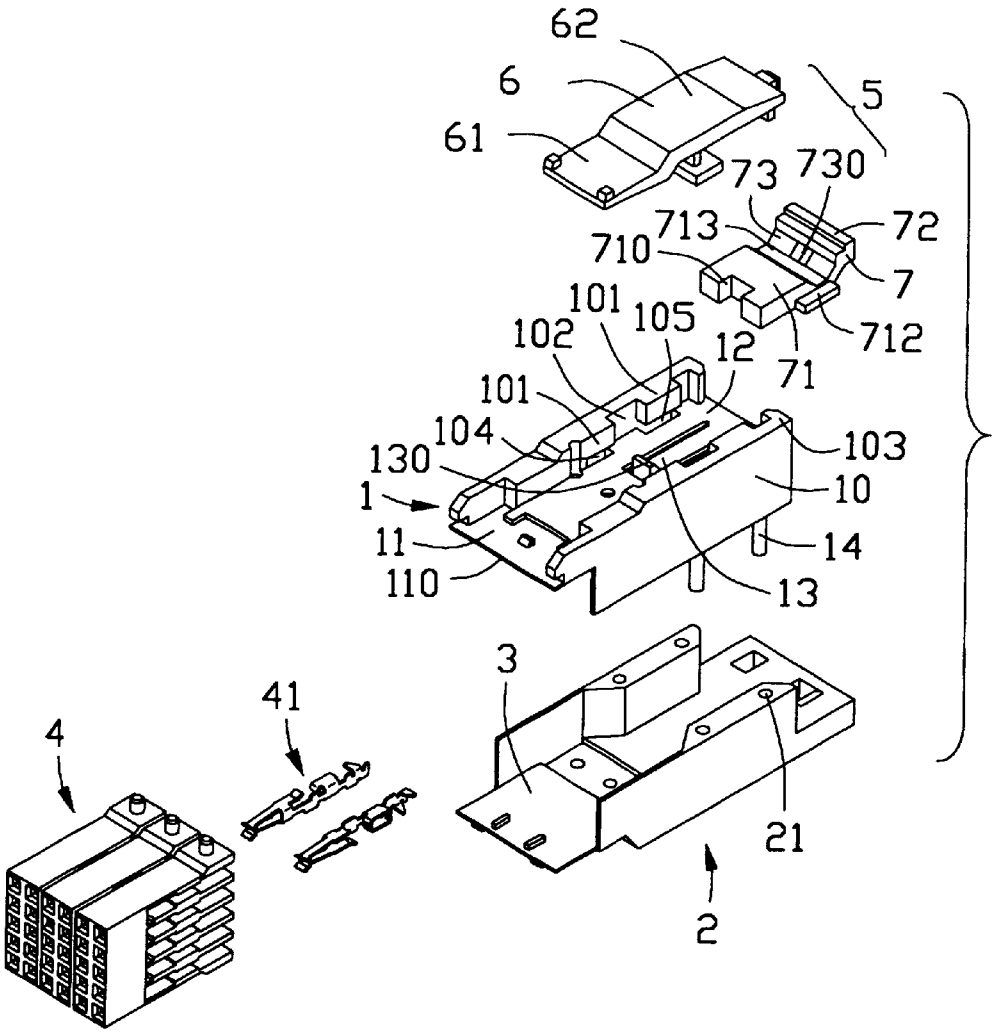
FIG. 1 is an exploded view of an electrical connector in accordance with the present invention.

Reference will now be made to the drawing figures to describe the present invention in detail.

An electrical connector in accordance with the present invention is shown in FIG. 1 and comprises an upper cover 1 and a lower cover 2, between which a receiving space 3 is defined for accommodating a terminal block 4 therein, and a latching means 5 assembled to the upper cover 1, wherein the terminal block 4 has a plurality of terminals 41 thereof for electrically connecting with corresponding contacts of a cooperating connector (not shown).

The upper cover 1 provides two side walls 10 standing along a length of the connector and an elongated panel 11 bounded on opposite sides by the side walls 10, which defines a recess 12 on a top thereof for receiving the latching means 5 and the receiving space 3 under a bottom for retaining the cooperating connector therein. A resilient tongue 13 is provided on the top of the panel 1 land extends at a distance from and parallel to the side walls 10, with which a hook 130 is formed at a free end thereof in a direction toward a mating side 110 of the upper cover 1. Two pairs of elongated blocks 101 extend oppositely from the side walls 10 and protrude into the recess 12, each two at same side being spaced a distance from one another. A pair of notches 102 are defined respectively on the two side walls 10 between each pair of elongated blocks 101, which is provided for the latching means 5 to pass therethrough and be assembled to the upper cover 1. Each of side wall 10 forms a stopper 103 individually on a rear end thereof opposite to the mating side 110 for preventing the assembled latching means 5 from breaking away from the upper cover 1. Two pairs of slots 104 are defined on the elongated panel 11 along interconnecting edges formed between the panel 11 and the side walls 10, each being opposite to the corresponding block 101. Under every elongated block 101, a groove 105 is defined on the upper cover 1 and communicating with every slot 104. A plurality of posts 14 are extending downwardly from the side walls 10 on the bottom of the upper cover 1 for engaging with corresponding passageways 21 of the lower cover 2 to lock the upper and lower covers 1, 2 together.

Figure 3:
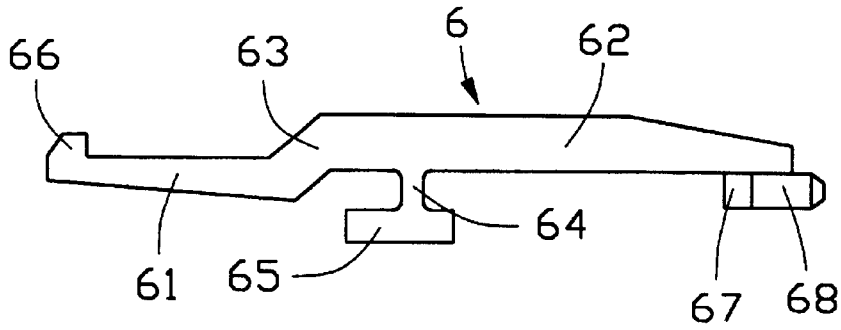
FIG. 3 is a side view of a latch of the present invention

Referring to FIGS. 1 and 3, the latching means 5 is composed by a latch 6 and a slide knob 7 engaging with the latch 6. The latch 6 defines a protruding portion 61, a main portion 62 and a connecting portion 63 connecting thereto. The protruding portion 61 and the main portion 62 each forms a free end oppositely. A pivot point 64 is provided on a bottom of the latch 6 being approximate to the connecting portion 63. The two free ends of the protruding portion 61 and the main portion 62 can rotate round the pivot point 64. A retaining foot 65 projects from the pivot point 64 and extends parallelly to the main portion 62 of the latch 6 for engaging with the upper cover 1. A pair of barbs 66 are formed on the free end of the protruding portion 61 and positioned oppositely to the retaining foot 65. On the free end of the main portion 62, a projecting strip 67 is defined at the same side of the retaining foot 65 and spanning laterally the free end. A tongue 68 formed in a middle of the projecting strip 67 extends rearwards beyond the free end of the main portion 62. The slide knob 7 includes a head 71, a driving portion 72 and an inclined neck 73 for connecting the head 71 and the driving portion 72. The head 71 defines a cutout 710 in a front thereof opposite to the driving portion 72 and a rectangular recess 711 in a bottom thereof. A pair of ears 712 extend outwardly from opposite sides of the head 71 with a lower face thereof coplanar to the bottom of the head 71. A channel 713 is defined on a rear of the head 71 near to the inclined neck 73. The inclined neck 73 extends upwards and rearwards and connects to the driving portion 72 which is parallel to the head 71. A rectangular opening 730 is defined on the inclined neck 73 communicating with the channel 713 of the head 71 for engaging with corresponding tongue 68 of the latch 6.

Figure 2:
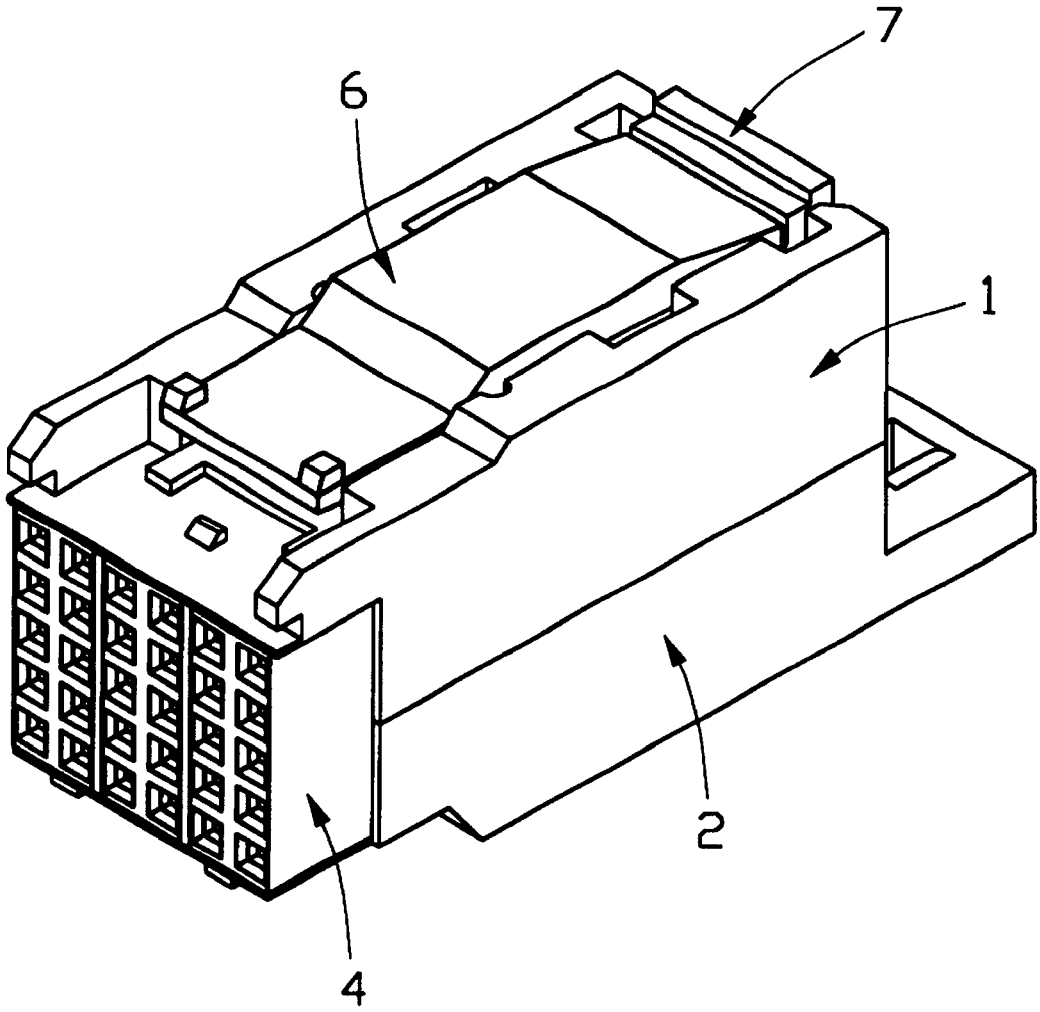
FIG. 2 is an assembled view of FIG. 1.

In assembly, referring to FIGS. 1 and 2, firstly, the slide knob 7 is positioned in the corresponding elongated recess 12 of the upper cover 1 from the top thereof, whereby the ears 712 of the slide knob 7 are slidably received in the rear pair of grooves 105 of the upper cover 1 and the driving portion 72 thereof situates outside the upper cover 1. Then, the latch 6 is assembled in the same recess 12 as the slide knob 7, whereby opposite sides of the retaining foot 65 are received in corresponding front pair of grooves 105 and a rear edge of the retaining foot 65 abuts against the hook 130 of the resilient tongue 13 on the upper cover 1. An external force is horizontally exerted on the driving portion 72 of the slide knob 7 and the slide knob 7 is pushed into the recess 12 of the upper cover 1 with a rear edge of the slide knob 7 and a rear side of the upper cover 1 being in a same plane. Finally, the upper cover 1 with the latching means 5 thereon couples with the lower cover 2 and the terminal block 4 with a plurality of terminals 41 therein is inserted into the receiving space 3 between the upper cover 1 and the lower cover 2.

Figure 4:
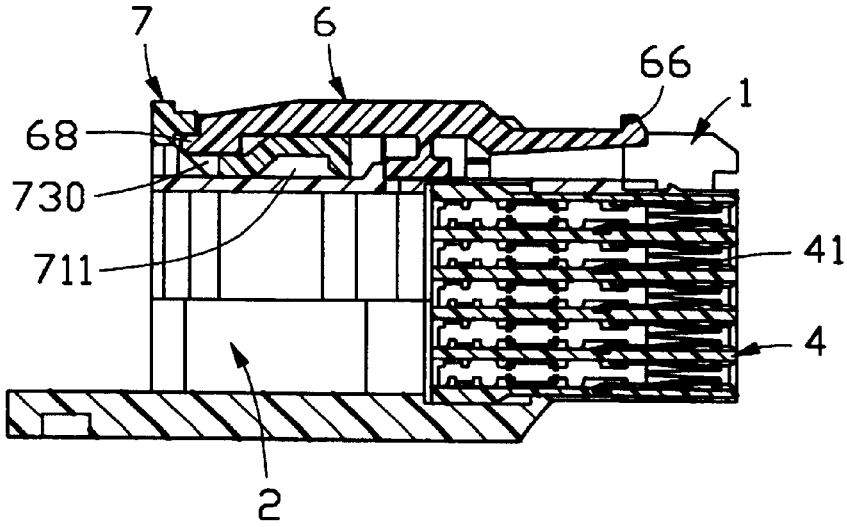
FIG. 4 is a cutaway view of FIG. 2 showing the electrical connector in a locking state with a mating connector being removed therefrom and FIG. 5 is a view similar to FIG. 4 showing the electrical connector in an unlocking state with the mating connector being removed therefrom.
Figure 5:
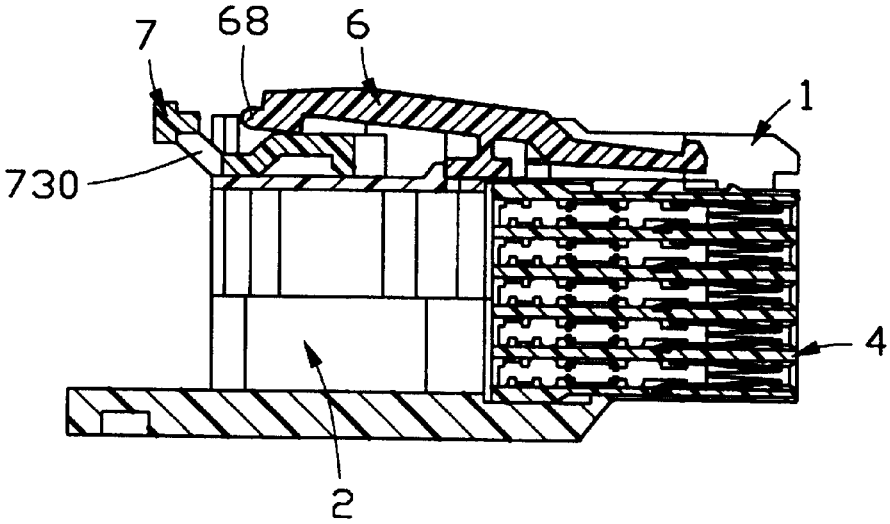

During operation, when the electrical connector in accordance with the present invention couples with the mating connector, the pair of barbs 66 on the protruding portion 61 of the latch 6 engage with the corresponding slots defined in the mating connector. The engagement between the latch 6 and the slide knob 7 is shown in FIG. 4. The tongue 68 of the latch 6 extends into the rectangular opening 730 of the inclined neck 73 of the slide knob 7 and the front of the slide knob 7 abutting against the rear edge of the retaining foot 65 with the cutout 710 of the slide knob 7 receiving the hook 130 of the resilient tongue 13. When the electrical connector disengages from the mating connector, a force is exerted on the driving portion 72 and the driving portion 72 is outside the upper cover 1, as shown in FIG. 5. During pulling the slide knob 7 outwards, the main portion 62 of the latch 6 slides from the opening 730 of the inclined neck 73 onto the head 71 through the channel 713 thereof. At the same time, the latch 6 pivots about the pivot point 64 and the protruding portion 61 of the latch 6 rotates in a direction toward the electrical connector with the pair of barbs 66 thereon disengaging from the corresponding slots of the mating connector. The ears 712 of the slide knob 7 are stopped by the stoppers 103 of the upper cover 1 to maintain the slide knob 7 in the recess 12 of the upper cover 1.

The latching means 5 of the electrical connector in accordance with the present invention simplifies the manufacturing of the connector, therefore the cost of the connector is reduced. Moreover, the present invention provides a convenient operation to locking the connector and the mating connector together and it is easy to distinguish a locking state from an unlocking state. Moreover, in a locking state, the tongue 60 extends into the opening 730 and is pressed downwardly by the slide knob 7 so as to prevent inadvertent deflection of the latch 6 and assure the engagement with the mating connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for coupling with a mating connector comprising:

an upper cover having an elongated recess defined on a top thereof;

a lower cover cooperating with the upper cover, a receiving space being defined between the upper cover and the lower cover;

a terminal block retaining a plurality of terminals therein for being received in the receiving space;

a latch having one pivot point, two opposite free ends, a tongue projecting from one of the two free ends, and a pair of barbs formed at the other free end to snap into slots defined in the mating connector; and a slide knob comprising a head, a driving portion and a neck connecting the head to the driving portion, the neck defining an opening therein for engaging with the tongue of the latch, a pushing/pulling operation of the driving portion making the tongue extend into or leave from the opening and causing the barbs of the latch to pivot about the pivot point, which results in the barbs engaging with or disengaging from the slots of the mating connector, thereby locking/unlocking the electrical connector with the mating connector, wherein the upper cover forms a pair of side walls with an elongated panel interconnecting therebetween, two pairs of blocks extend oppositely from a top of the side walls and are spaced from each other, and two pairs of grooves are respectively defined between the top of the upper cover and the blocks;

wherein the latch comprises a main portion having the pivot point, a protruding portion with the pair of barbs thereon, and a connecting portion connecting the main portion to the protruding portion;

wherein a retaining foot connecting with the pivot point of the latch extends at a distance from and parallel to the main portion, opposite sides of which are slidably received in the corresponding grooves of the upper cover and retained therein, the latch being able to pivot about the pivot point;

wherein the upper cover defines a mating side in one end thereof and a resilient tongue in a middle of the top opposite to the mating side, the resilient tongue has a free end thereof toward the mating side and a hook is formed at the free end, whereby the retaining foot of the latch abuts against the hook at a rear end thereof;

wherein the slide knob defines a channel between the head and the neck and communicates with the opening of the neck, which provides a path for the tongue of the latch sliding therethrough, a pair of ears formed at opposite sides of the head for being slidably received in the corresponding grooves of the upper cover, the slide knob also having a cutout in a front thereof to receive the hook of the resilient tongue;

wherein a pair of stoppers extending from the side walls are located on the top of the upper cover opposite to the mating side for preventing the slide knob from dropping out of the upper cover by means of holding up the ears of the slide knob;

wherein a pair of notches are defined between each pair of the grooves on the upper cover;

wherein the neck of the slide knob is shaped as an incline and the driving portion extends parallel to the head.

* * * * *